US009102386B2

(12) United States Patent
Roach et al.

(10) Patent No.: US 9,102,386 B2
(45) Date of Patent: Aug. 11, 2015

(54) ENHANCED WATERCRAFT

(71) Applicants: Richard S Roach, Corralitos, CA (US); Karen M Roach, Corralitos, CA (US)

(72) Inventors: Richard S Roach, Corralitos, CA (US); Karen M Roach, Corralitos, CA (US)

( * ) Notice: Subject to any disclaimer, the term of this patent is extended or adjusted under 35 U.S.C. 154(b) by 157 days.

(21) Appl. No.: 14/012,226

(22) Filed: Aug. 28, 2013

(65) Prior Publication Data

US 2014/0063828 A1 Mar. 6, 2014

Related U.S. Application Data

(60) Provisional application No. 61/693,929, filed on Aug. 28, 2012.

(51) Int. Cl.

| | |
|---|---|
| ***B63B 35/73*** | (2006.01) |
| ***B63B 35/79*** | (2006.01) |
| ***B63B 45/04*** | (2006.01) |
| *B63B 17/00* | (2006.01) |

(52) U.S. Cl.

CPC ..... *B63B 35/7933* (2013.01); *B63B 45/04* (2013.01); *B63B 35/79* (2013.01); *B63B 2017/0045* (2013.01)

(58) Field of Classification Search

None

See application file for complete search history.

(56) References Cited

U.S. PATENT DOCUMENTS

| | | | | |
|---|---|---|---|---|
| 5,163,550 | A * | 11/1992 | Hawk | 206/315.1 |
| 5,894,811 | A * | 4/1999 | Nordby | 114/347 |
| 7,374,207 | B2 * | 5/2008 | McCoy | 280/815 |
| 8,191,712 | B2 * | 6/2012 | Koett | 206/586 |
| 2005/0023177 | A1 * | 2/2005 | Kiger et al. | 206/522 |

* cited by examiner

*Primary Examiner* — Britt D Hanley

(74) *Attorney, Agent, or Firm* — Donald R. Boys; Central Coast Patent Agency, Inc.

(57) ABSTRACT

A paddleboard system includes a paddleboard having an upper surface, a lower surface and a specific peripheral outer shape, and a fitted skirt having the specific peripheral outer shape of the paddleboard and additional material providing a first extension on the lower surface and a second extension on the upper surface fully around the specific peripheral outer shape, such that the fitted skirt is enabled to engage the paddleboard and stay in place in use.

15 Claims, 8 Drawing Sheets

*Fig. 1 - Prior Art*

ENHANCED WATERCRAFT

CROSS-REFERENCE TO RELATED DOCUMENTS

The present invention claims priority to a U.S. provisional patent application 61/693,929, filed Aug. 28, 2012 and entitled "Enhanced Watercraft", disclosure of which is incorporated herein in its entirety at least by reference.

BACKGROUND OF THE INVENTION

1. Field of the Invention

This invention is in the technical area of primarily personal watercraft, and pertains more particularly to peripheral equipment and enhancements for paddleboards, kayaks, canoes, and surfboards.

2. Description of Related Art

Paddleboards, and other watercraft of many different descriptions and manufacture, are known in the art. There are, in the present inventor's opinion, many shortcomings that might be provided to improve the utility of such watercraft. Enhancements and improvements according to embodiments of the present invention are provided and described in enabling detail below, and apply to all such watercraft.

BRIEF SUMMARY OF THE INVENTION

In an embodiment of the invention a paddleboard system is provided, comprising a paddleboard having an upper surface, a lower surface and a specific peripheral outer shape, and a fitted skirt having the specific peripheral outer shape of the paddleboard and additional material providing a first extension on the lower surface and a second extension on the upper surface fully around the specific peripheral outer shape, such that the fitted skirt is enabled to engage the paddleboard and stay in place in use.

In one embodiment material of the skirt is woven cloth, and the skirt additionally comprises a drawstring channel around an inner edge of the second extension with a drawstring and an opening at one point, enabling drawing the skirt tightly to the paddleboard. Also in one embodiment there are one or more elastic bands joined to the fitted skirt, providing tension to engage the skirt to the paddleboard.

In one embodiment the material of the skirt is a stretchable rubberlike material molded in the peripheral outer shape of the paddleboard, smaller then the shape of the paddleboard by an amount that the skirt is enabled to be stretched over the shape of the paddleboard. Also in one embodiment there is further a plurality of light-emitting diodes (LEDs) joined to fabric of the fitted skirt in a manner to be visible to observers, the LEDs wired together and the wiring having a connector to a power supply. In one embodiment there is a rechargeable battery incorporated into the fitted skirt, and in another a rechargeable battery integrated on or into the paddleboard.

In yet another embodiment of the invention the system comprises a control system coupled to the wiring of the LEDs and enabled to control one or more of lighting of individual LEDs, timing of on-off for individual and groups of LEDs, and color of LEDs. In some cases the control system is built into the upper surface of the paddleboard, including input mechanisms for a user to initiate functions of the control system, and in other embodiments there is an oar for use in propelling the paddleboard, and the control system is incorporated in the oar, including input mechanisms for a user to initiate functions of the control system.

In some embodiments with the stretchable rubberlike material there is also a plurality of light-emitting diodes (LEDs) joined to material of the fitted skirt in a manner to be visible to observers, the LEDs wired together and the wiring having a connector to a power supply. In these embodiments as well there may be rechargeable battery incorporated into the fitted skirt, or integrated on or into the paddleboard.

In embodiments with the stretchable rubberlike material there may be a control system coupled to the wiring of the LEDs and enabled to control one or more of lighting of individual LEDs, timing of on-off for individual and groups of LEDs, and color of LEDs. The control system may be built into the upper surface of the paddleboard, including input mechanisms for a user to initiate functions of the control system, or may be incorporated in an oar for use in propelling the paddleboard, wherein the control includes input mechanisms for a user to initiate functions of the control system.

BRIEF DESCRIPTION OF THE SEVERAL VIEWS OF THE DRAWINGS

FIG. 7 is a view of a paddleboard in an embodiment of the invention with a battery compartment and control switches built in.

DETAILED DESCRIPTION OF THE INVENTION

Figure 1:
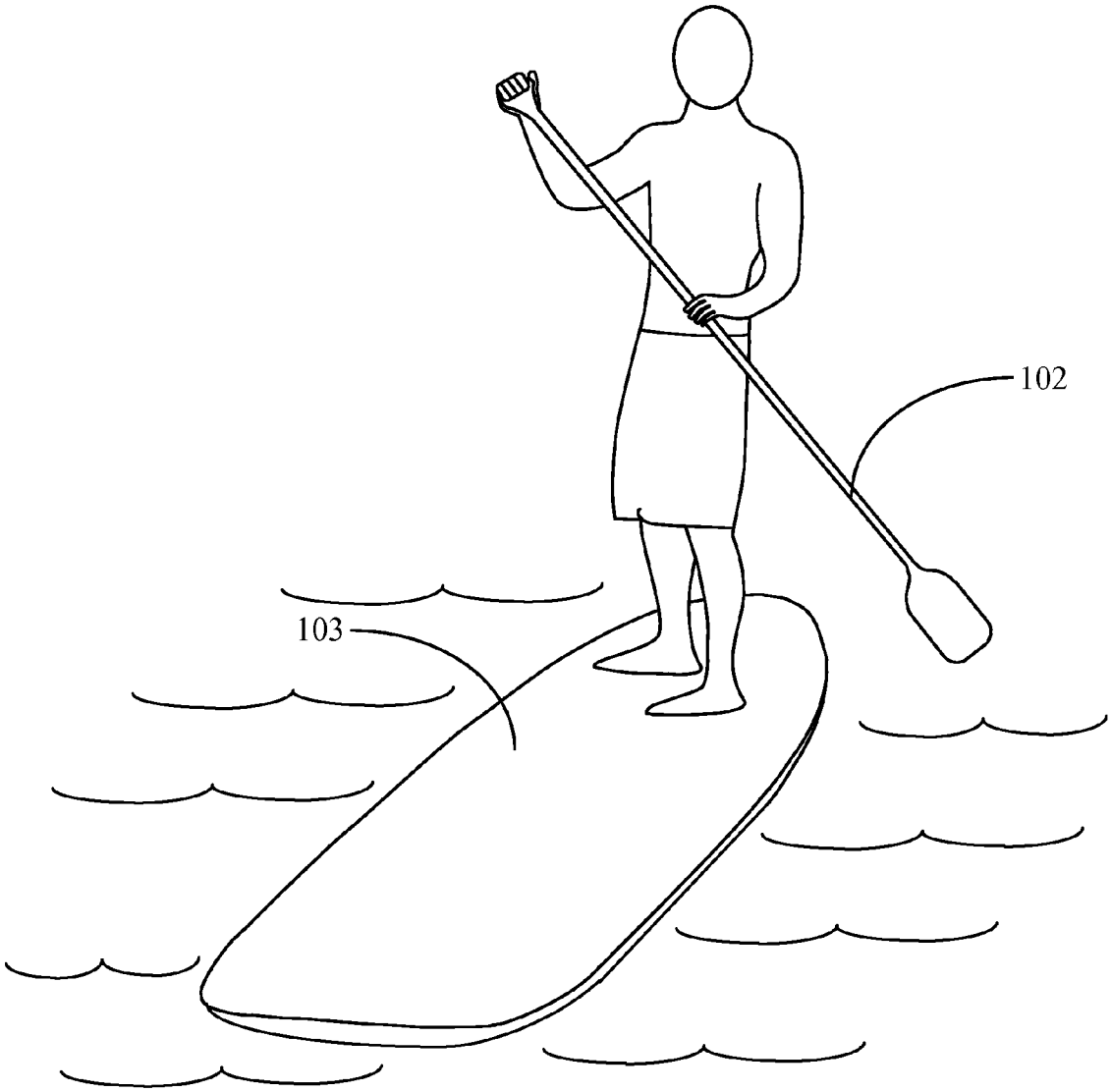
FIG. 1 is a view of a person standing upright on a stand-up paddleboard in the prior art.

FIG. 1 is a view of a young man standing upright on a stand-up paddleboard 101, holding a single paddle 102. The paddleboard shown is typical of many, which are buoyant enough that an adult may stand upright and the board will remain floating and stable. Paddleboards are commercially available in differing size and buoyancy for children and adults, and a person may choose and purchase a paddleboard suitable to that person's size and weight as well as ability or discipline.

It may be seen in FIG. 1, which is representative of the art at the time of filing the present application, that such boards typically are a bit upturned in the forward and, that is, the direction the board will be propelled, and typically have a marked area for the user to stand. That area may have a non-slip surface applied for convenience. It is clear in FIG. 1 as well that the paddle has a substantially elongated handle and a broad functional end, because the paddle is used while standing, and the length is convenient for a sure stroke. Paddleboards are used in following descriptions of embodiments of the present invention, and are an important area of application of principles and enhancements of the invention. It is to be understood, however, that many of the peripherals and enhancements described may be applied to personal watercraft of other sorts.

As paddleboarding has developed as a sport and a pastime, night use has become popular. The present invention pertains particularly to enhancements for night use with paddleboards, paddles and leashes, and to other watercraft and peripheral equipment, but night use is not a specific limitation.

The board seen in FIG. 1 may a decorative exterior with some color and symbols. One object of the present invention is to provide elements whereby the appearance of such a board may be easily changed, particularly at night. In following descriptions paddleboards are referenced as watercraft benefiting from enhancements and improvements according to embodiments of the invention, but paddleboard are just one sort of watercraft that may benefit. Many embodiments described are equally applicable to such as kayaks, canoes, and surfboards, as well as to other sorts of watercraft.

Figure 2:
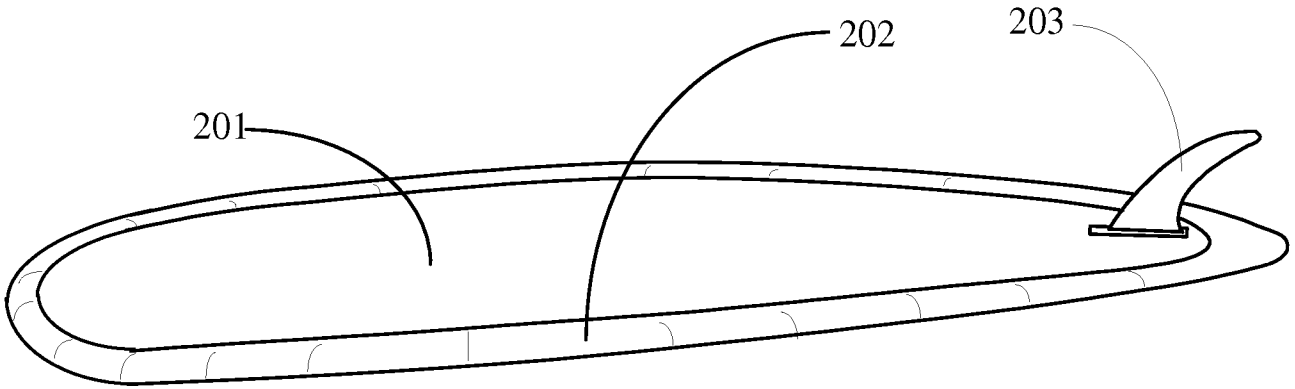
FIG. 2 is a view of a paddleboard having a fabric skirt according to an embodiment of the present invention.

FIG. 2 is a view of a paddleboard 201 lying out of the water and upside down, showing a rear-mounted small keel or fin 203, which is provided on many models of paddleboards to help stabilize the board in use and to prevent side-sliding when paddling and changing direction. Paddleboard 201 has in this embodiment an add-on fabric skirt 202 which in many embodiments has a vibrant color and design. The skirt is made to be of a size to fit this particular board, or many boards of this approximate size, and is assembled to the board around edges of the board. The skirt may be continuous, or may have an interface where the skirt may be joined when fitted to the board.

Figure 3:
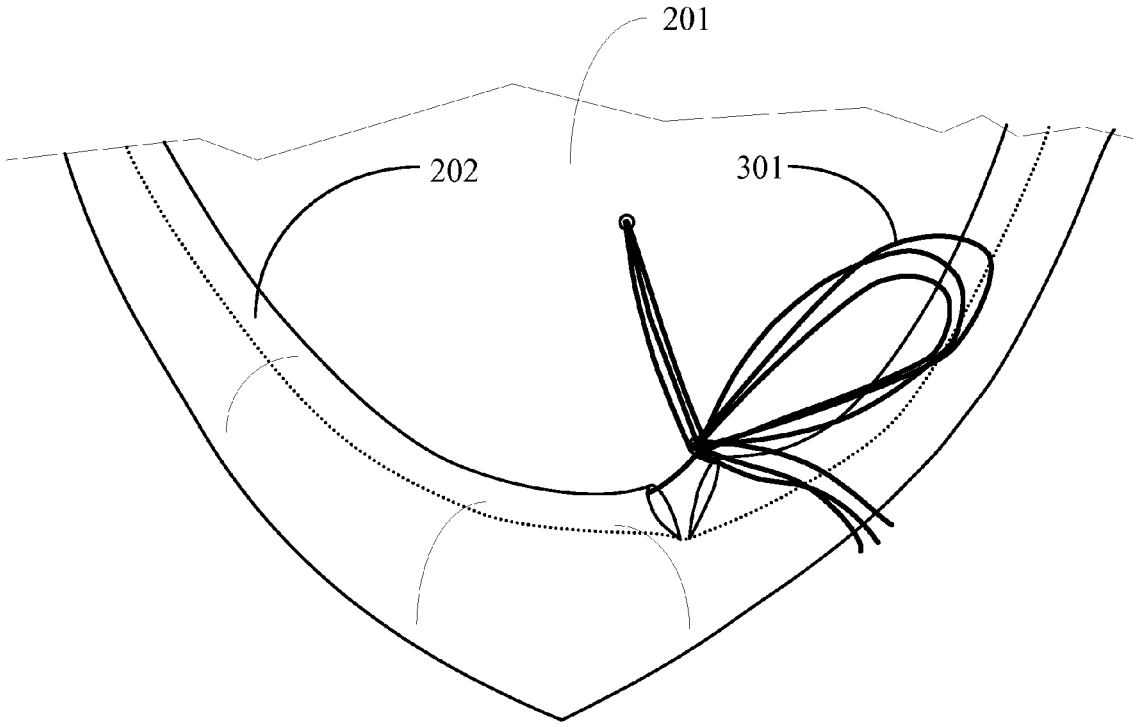
FIG. 3 is a view of a portion of the board of FIG. 2 showing a drawstring in an embodiment of the invention.

Skirt 202 is, in this embodiment, joined to the board by a drawstring 301 drawn taught and tied, as shown in FIG. 3. The skirt has a sewn-in channel around the periphery for the drawstring. It will be apparent to the skilled person that the channel may have an opening elsewhere than at the head end of the board as shown in FIG. 3, or may have a plurality of openings in different places in order to weave led light strips through. There also may be more than one drawstring. In alternative embodiments other means for tightening such a skirt may be use, such as elastic bands and the like.

Skirt 202 may be made of any one of a variety of materials, such as canvas fabrics, polyurethane, super flex sanaprene, plastic neoprene or any other suitable flexible material, and may have any one of many known protective materials applied to protect against salt water, physical damage, and harmful sun rays etc . . . Designs and colors may be applied in many different ways. Similarly the drawstring may be of any one of a variety of materials, such as plastics or fabric materials, and may in at least one embodiment be of a flexible material, such that the skirt may be quickly mounted, the flexibility of the string or skirt may hold the skirt in place, and there will be no need to tie or untie a drawstring if the skirt itself is of a flexible fabric, and a drawstring need not be used.

In another embodiment the fabric of the skirt may itself be a stretch fabric, and such a skirt may be quickly mounted or demounted by stretching the fabric to place the skirt in place or remove it from the paddleboard.

In another embodiment the skirt may itself be a translucent stretch polymer, plastic, sanaprene or any stretchable material that would also adhere to the board so that it stays in place by itself. Such a skirt may be quickly mounted or demounted by stretching the material to place the skirt in place or remove it from the paddleboard. Such a skirt (can be translucent) may also have lights molded in with the skirt so that the lights are protected from the water.

In another embodiment of the invention strips of phosphorescent material (commercially available) may be used instead of LED strips for at least some lighting elements on a watercraft. These strips gain energy during daylight hours from sunlight, and glow in the dark.

Figure 4:
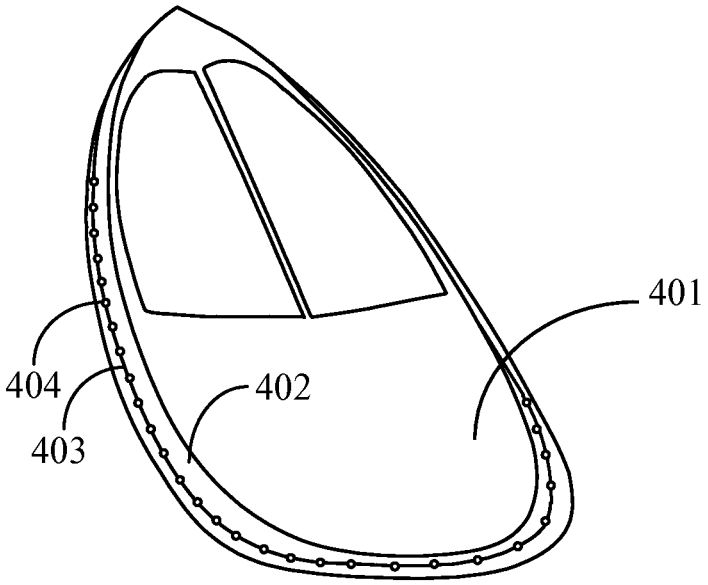
FIG. 4 is a view of a paddleboard in one embodiment of the present invention to which lighting has been applied.

In yet another embodiment of the present invention lights may be added in a variety of different ways to a paddleboard to enhance the use of such a board in low-light conditions, or at night. FIG. 4 is a view of a paddleboard in one embodiment to which lighting has been applied. In this particular example a long string 403 of connected green LEDs 404 has been assembled to paddleboard 401 by providing a transparent skirt 402 with a channel, similar to a drawstring channel, into which LED string 403 is inserted or woven. The insertion may be done before or after the skirt is applied to the paddleboard and an on-board battery may be provided as a power supply for the LEDs, along with an on-off switch. The battery and switch are not shown in FIG. 4, but may be provided in a number of different ways. For example, a rechargeable battery may be provided in the fabric of a skirt, with a tether to couple to a charging source as needed, either with the skirt in place on the paddleboard, or with the skirt removed. In other instances a battery may be provided in or on the board itself, such as in a well accessible from the top of the board.

The position of lighting elements on a paddleboard or other watercraft may be changed for different effects. For example, in some embodiments lighting elements may be positioned in various places and patterns on the top of the board, as well as in a skirt around the periphery of the board, or may be placed as well on the underside to produce perhaps a glow effect. There is no limitation as to the placement of lighting elements in the general sense.

Figure 5:
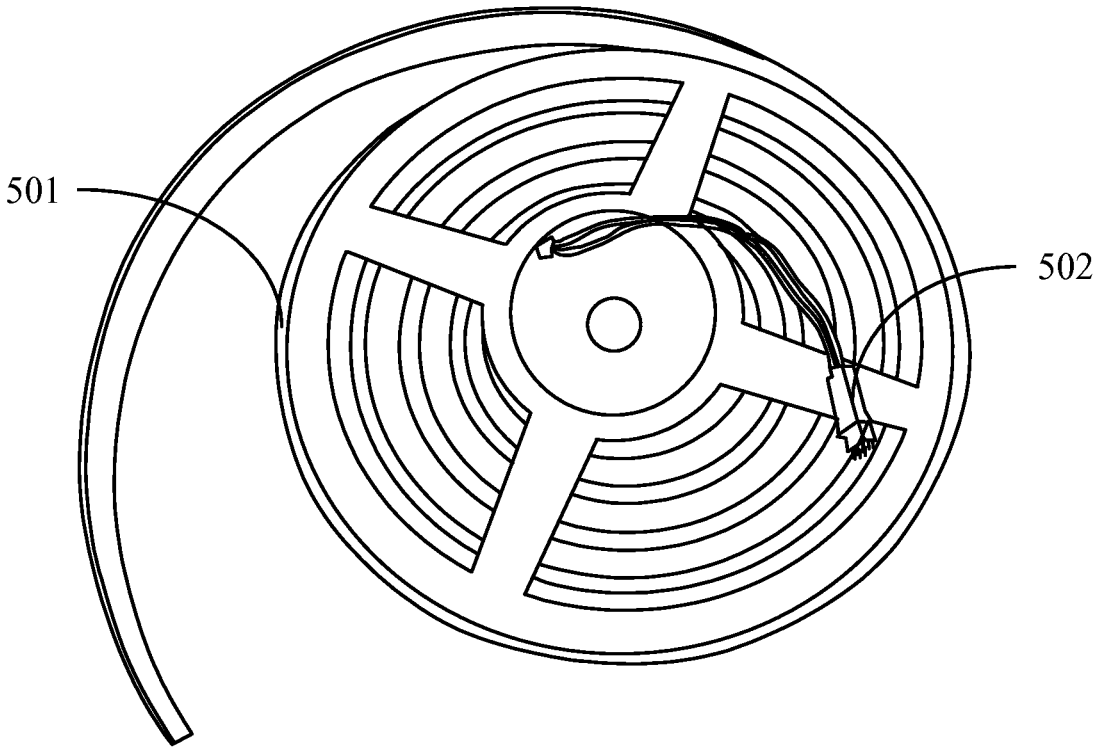
FIG. 5 shows a reel holding a long strip of LED waterproof lights.

FIG. 5 is a view of a reel 501 holding a long strip of LEDs, having an end connector 502 which is useful for connecting the strip to a battery pac or for connecting to another string of LEDs. Strips of this sort are commercially available, and may be capable of a single color, or many colors, which colors may be programmed to display in a pre-programmed order via a remote control. In other embodiments of the invention lighting elements may be provided in different ways.

Figure 6:
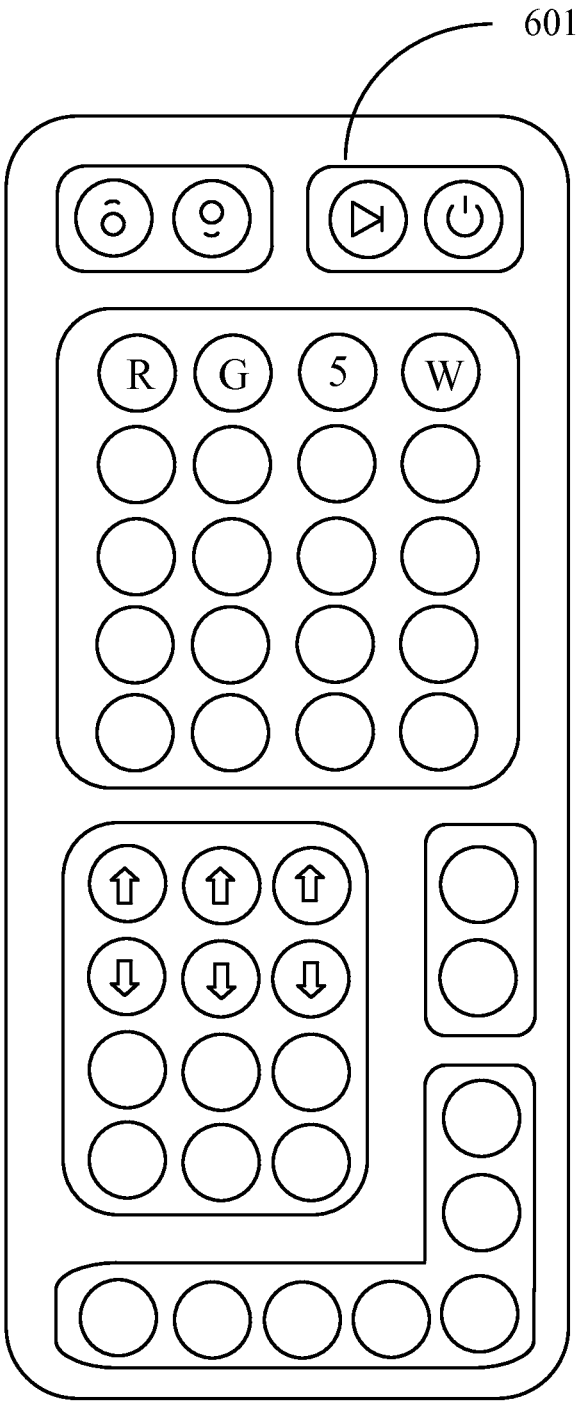
FIG. 6 shows a remote controller in an embodiment of the invention.

FIG. 6 is a view of an exemplary controller for use with an LED strip like the strip shown on reel 501 in FIG. 5, or for other lighting arrangements installed on a personal watercraft like a paddleboard. This controller has firmware and inputs whereby different programs of colors and timing may be displayed by the LEDs in the strip. Other inputs allow choice of colors and selectable color sequences, as well as changes in the timing for colors and flashing or fading. In other embodiments controllers may be provided that are programmable, and a user may develop different programs.

Figure 7:
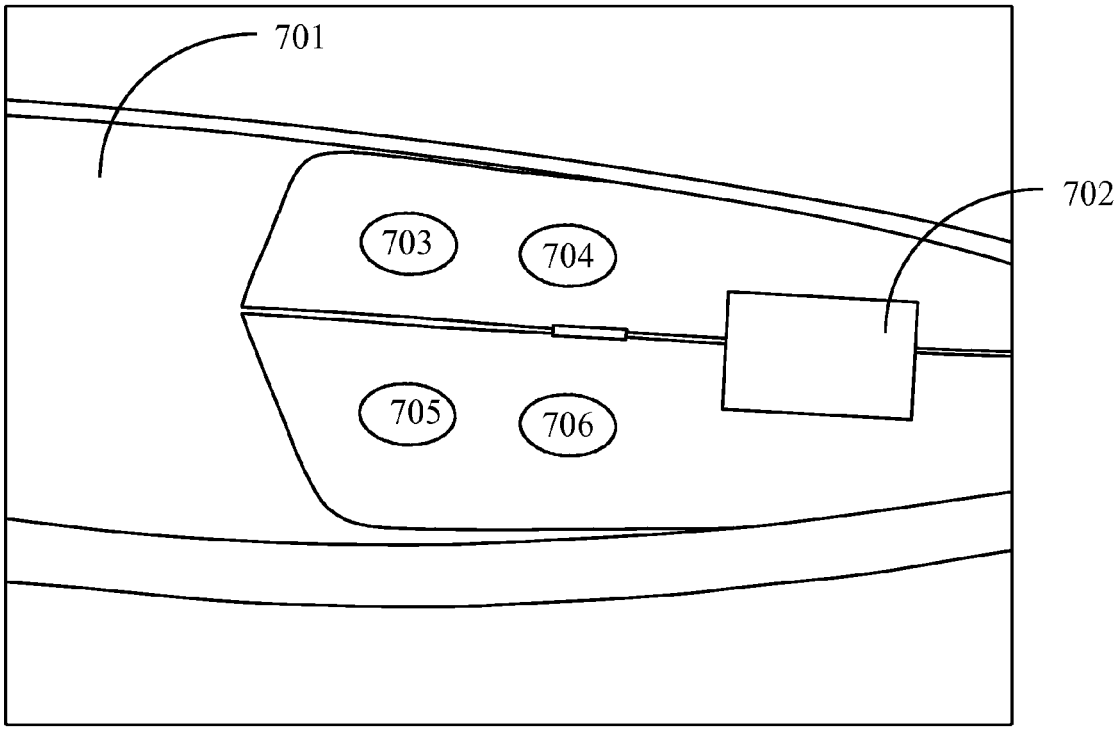

FIG. 7 is a plan view of a portion of a paddleboard 701 in an embodiment of the present invention, with a built-in battery compartment 702 and a user control interface comprising buttons 703, 704, 705 and 706. In this embodiment board 701 has a compartment formed into the board, which is sized a shaped for a battery. The compartment, with the battery installed, is covered with a waterproof cover 702. The battery may also be formed flat (not shown) with suction cups for adhesion to the board. The battery may be charged with solar during the day, or may be charged in any one of several conventional ways. There also may be a control board within the compartment with firmware and memory and other electronic components necessary for different control modes for lights. In some embodiments there are passages within board 701 from the battery compartment for wires, to connect to switches 703 through 706 and to LEDs and LED strips not shown.

Batteries and other forms of power may be supplied in many different ways, and the embodiments described herein are not limited by any specific mode of providing power.

Batteries may be in compartments in a board or in another sort of watercraft, or may be attached and carried in any of several different ways.

Switch 703 is in this example is an off-on toggle switch that turns the light system off and on. Switch 704, when the system is on, toggles between several preprogrammed sequences of colors and timing. Switches 705 and 706 may be used for different purposes. For example, in one embodiment switch 705 is a temporary disconnect switch that may be depressed by a user, by toe or heel, and the lights will be off while the switch is depressed, but come back on when the switch is released. This function may be used for signaling purposes by a user, because the user can control the timing of the off cycles. Users might employ pre-arranged signaling sequences, or even Morse code, for example. Switch 706 might be set up to provide a special color and rapid flashing to be recognized by other users as a distress signal. There are many possibilities.

In another embodiment transparent and semitransparent paddles are provided with LEDs inserted through passages drilled, molded or otherwise provided in the paddle shaft and/or the paddle end, along with a compartment for batteries and buttons on the handle end for a user to activate the LEDs and to initiate preprogrammed sequences of colors and timings. Solar may also be incorporated with the paddle to charge batteries contained within the paddle.

In yet another embodiment of the invention there is a power pack in or on the paddleboard along with circuitry for controlling LEDs associated with the board, either mounted in a skirt or embedded in the board itself or attached to the board, but control for the user is embodied in the paddle. In this embodiment a small power pack is provided in the handle and there is an interface with buttons and switches for the user to control all functions of the LEDs associated with the paddleboard. In one embodiment the paddle is tethered to the board by a communication cable, and inputs by the user are communicated to the board circuitry by this cable. This communications cable can also double as a lighted leash connecting the paddle to the board. In a preferred embodiment circuitry on the board and in the handle of the paddle is enabled for Bluetooth™ or any other wireless communication protocols that exist, and signals are communicated wirelessly. In some other embodiments there may also be a speaker and a microphone, and a user's paddle may connect to another user's paddle, such that users within wireless range may talk to one another. Control of another's lights may also be accomplished for a variety of purposes. In another embodiment one user controls the lights associated with a plurality of other users boards so that folks on shore may enjoy a choreographed light show of sorts. Control of a plurality of lighted boards may also be done from shore by a master controller. Emergency light communication may also be done via wireless technology alerting other users of a particular emergency or other communication.

In some embodiments a paddle may have glow-in-the-dark either in channels in the paddle or joined to the outside of the paddle. In other embodiments there may be a leash that is used to tether a person to the board or watercraft, and the leash may be enhanced with lighting elements.

Figure 8:
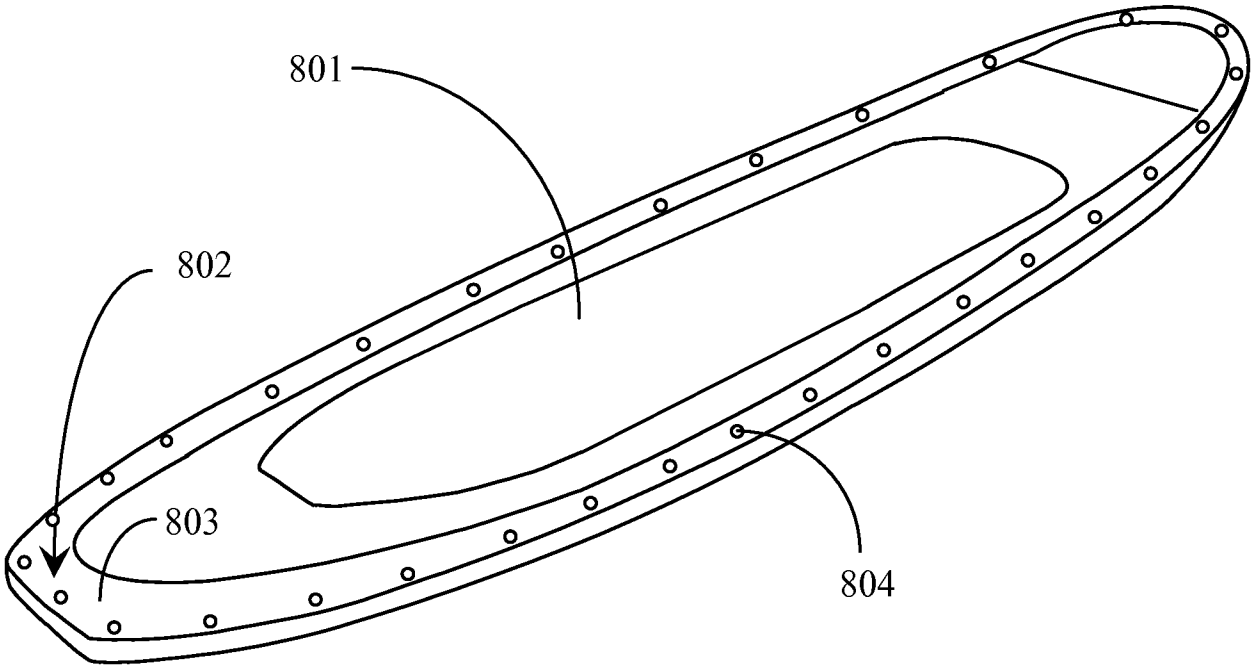
FIG. 8 illustrates yet another embodiment of the invention wherein a paddleboard has a skirt that is molded in a flexible, rubberlike material such as neoprene.

FIG. 8 illustrates yet another embodiment of the invention wherein a paddleboard 801 has a skirt 802 that is molded in a flexible, rubberlike material such as neoprene. Skirt 802 is molded in the shape of a particular board for which the skirt is intended, but is molded at a somewhat smaller size than the exact outside shape of the paddleboard. The difference will be a small percentage, such as from 5% to 10%. The skirt may then be stretched over the paddleboard, and will be firmly positioned when installed. It may be seen in FIG. 8 that skirt 802 has a portion 803 that may lie flat on the top of the paddleboard. This flat portion may be shaped differently for different models of skirts for a particular paddleboard, to provide an extensive upper region, or a small upper region.

In some embodiments LEDs or other lighting elements 804 may be integrated with skirt 802. An LED strip may be provided within the skirt with openings for the individual LEDs 804 to show through the skirt. With lighting elements, batteries may be provided as described above, either in the skirt, or in or on the board, and control elements as also described above may also be provided.

The skilled person will understand that there are many alterations that might be made to the embodiments described above without departing from the spirit and scope of the invention.

The invention claimed is:

1. A paddleboard system, comprising:

a paddleboard having an upper surface, a lower surface and a specific peripheral outer shape; and a fitted skirt having the specific peripheral outer shape of the paddleboard and additional material providing a first extension on the lower surface and a second extension on the upper surface fully around the specific peripheral outer shape, and a plurality of light-emitting diodes (LEDs) connected to a power supply and joined to the fitted skirt, such that the fitted skirt is enabled to engage the paddleboard and stay in place, and the LEDs are enabled to be powered on while the paddleboard is in use in water.

2. The paddleboard system of claim 1 wherein material of the skirt is woven cloth, and the skirt additionally comprises a drawstring channel around an inner edge of the second extension with a drawstring and an opening at one point, enabling drawing the skirt tightly to the paddleboard.

3. The paddleboard system of claim 2 further comprising one or more elastic bands joined to the fitted skirt, providing tension to engage the skirt to the paddleboard.

4. The paddleboard system of claim 1 wherein the material of the skirt is a stretchable rubberlike material molded in the peripheral outer shape of the paddleboard, smaller then the shape of the paddleboard by an amount that the skirt is enabled to be stretched over the shape of the paddleboard.

5. The paddleboard system of claim 1 further comprising a rechargeable battery incorporated into the fitted skirt.

6. The paddleboard system of claim 1 further comprising a rechargeable battery integrated on or into the paddleboard.

7. The paddleboard system of claim 1 further comprising a control system coupled to the wiring of the LEDs and enabled to control one or more of lighting of individual LEDs, timing of on-off for individual and groups of LEDs, and color of LEDs.

8. The paddleboard system of claim 7 wherein the control system is built into the upper surface of the paddleboard, including input mechanisms for a user to initiate functions of the control system.

9. The paddleboard system of claim 7 further comprising an oar for use in propelling the paddleboard, wherein the control system is incorporated in the oar, including input mechanisms for a user to initiate functions of the control system.

10. The paddleboard system of claim 4 further comprising a plurality of light-emitting diodes (LEDs) joined to material of the fitted skirt in a manner to be visible to observers, the LEDs wired together and the wiring having a connector to a power supply.

11. The paddleboard system of claim 10 further comprising a rechargeable battery incorporated into the fitted skirt.

12. The paddleboard system of claim 10 further comprising a rechargeable battery integrated on or into the paddleboard.

13. The paddleboard system of claim 10 further comprising a control system coupled to the wiring of the LEDs and enabled to control one or more of lighting of individual LEDs, timing of on-off for individual and groups of LEDs, and color of LEDs.

14. The paddleboard system of claim 13 wherein the control system is built into the upper surface of the paddleboard, including input mechanisms for a user to initiate functions of the control system.

15. The paddleboard system of claim 13 further comprising an oar for use in propelling the paddleboard, wherein the control system is incorporated in the oar, including input mechanisms for a user to initiate functions of the control system.

* * * * *